US007992241B2

(12) United States Patent
Davis, III

(10) Patent No.: US 7,992,241 B2
(45) Date of Patent: Aug. 9, 2011

(54) UPPER BODY ELEVATOR

(76) Inventor: Thomas W. Davis, III, Bethany, LA (US)

( * ) Notice: Subject to any disclaimer, the term of this patent is extended or adjusted under 35 U.S.C. 154(b) by 0 days.

(21) Appl. No.: 12/380,728

(22) Filed: Mar. 3, 2009

(65) Prior Publication Data

US 2009/0222991 A1 Sep. 10, 2009

Related U.S. Application Data

(60) Provisional application No. 61/068,081, filed on Mar. 4, 2008.

(51) Int. Cl.
*A47C 16/00* (2006.01)

(52) U.S. Cl. ..... 5/655.3; 5/710

(58) Field of Classification Search ..... 5/655.3, 5/710

See application file for complete search history.

(56) References Cited

U.S. PATENT DOCUMENTS

| | | | | |
|---|---|---|---|---|
| 3,408,107 | A * | 10/1968 | Savage | 297/452.41 |
| 4,639,960 | A * | 2/1987 | Quillen et al. | 5/710 |
| 5,699,569 | A * | 12/1997 | Schwarz-Zohrer | 5/655 |
| 6,499,166 | B1 * | 12/2002 | Jones | 5/715 |
| 6,671,910 | B2 * | 1/2004 | Hsu et al. | 5/710 |
| 6,886,204 | B2 * | 5/2005 | Kasatshko et al. | 5/722 |
| 2003/0024049 | A1 * | 2/2003 | Hsin | 5/706 |
| 2005/0273937 | A1 * | 12/2005 | Chen | 5/706 |
| 2005/0278861 | A1 * | 12/2005 | Kasatshko | 5/713 |
| 2007/0028388 | A1 * | 2/2007 | Fletcher | 5/655.3 |

* cited by examiner

*Primary Examiner* — Robert G Santos
*Assistant Examiner* — Brittany M Wilson
(74) *Attorney, Agent, or Firm* — R. Keith Harrison

(57) ABSTRACT

An upper body elevator includes a generally wedge-shaped elevator body comprising a lower elevator pillow comprising a first plurality of adjacent air tubes and an upper elevator pillow comprising a second plurality of adjacent air tubes carried by the lower elevator pillow.

7 Claims, 4 Drawing Sheets

UPPER BODY ELEVATOR

CROSS-REFERENCE TO RELATED APPLICATIONS

The present Utility patent application claims priority benefit of the U.S. provisional application for patent U.S. 61/068,081, entitled "Upper Body Elevator" and filed on Mar. 4, 2008 under 35 U.S.C. 119(c) by the present inventor. This device relates to lounging devices and more specifically to such devices which are suitable for recreational and therapeutic needs. The contents of this related provisional application are incorporated herein by reference.

BACKGROUND OF THE INVENTION

Field of the Invention

The present device relates generally to recreational and therapeutic lounging devices. More particularly, the device relates to an indoor/outdoor upper body elevation device specifically suitable for anyone.

In most cases people lounge for either recreation or therapy; whichever the case may be, proper upper body support is necessary. In some cases, consumers have back, neck, shoulder, stomach and other ailments that prevent them from lying flat or lounging in a semi-upright position. In other cases consumers prefer to lounge in an upright position strictly for recreational purposes. It is accordingly an object of the present invention to greatly increase the comfort of the consumer while adding light-weight and portable features that will result in the multi-purpose use of this device. Known devices for positioning include but are not limited to variations of supportive pillows of soft or in some cases beaded filling or memory foam wedges that do not provide the firm support surface, mobility, cost-efficiency and durability of this particular device.

Some known devices are larger foam wedges providing only one angle of elevation without the ability to move easily into different areas. There are wedges that are used strictly in medical professions for supporting the buttocks and groin area or inclined mattresses—which are too expensive for the average consumer. With the main support of the upper body elevator relieving strain from the upper body, lounging in a semi-upright position can be less restrictive to the consumer, comfortable, and even prevent from cutting off the blood circulation to the legs.

Yet other known devices for upright lounging are recommended for use in one area or another, they are not portable and cannot be taken with you. What is commonly used in the home to position consumers in an upright lounging position are pillows and rolled up blankets to prop up the consumer on flat or elevated mattresses or in non-adjustable seats.

In view of the foregoing, a device is needed for the upright positioning for reading, watching television, napping or any other recreational purposes used when in a semi-upright position. A device is also needed for the upright positioning of a consumer's head, neck and chest that will alleviate gastric reflux or airway blockage and is safe, portable, easy to use, light-weight and effective for therapeutic needs. It would further be desirable if the device also provides safe, easy, effective, accessible and comfortable positioning of the consumer's head, neck, chest and lower body, to facilitate effective air exchange and for the relief of gastric reflux (at least a 30 degree inclination is recommended, to employ gravity to keep food in stomach and facilitate gas to be expelled by burping), apnea associated with airway blockage due to poor positioning of the head, and dyspnea related to cardiac and or pulmonary conditions such as asthma, bronchiolitis, pneumonia, other infections, prematurity, surgical conditions or lack of muscle tone, in the home setting.

BRIEF DESCRIPTION OF THE DRAWINGS

The present invention is illustrated by way of example, and not by way of limitation, in the figures of the accompanying drawings and in which like reference numerals refer to similar elements and in which:

FIG. 2 shows a view from above for a better understanding of what the Upper Body Elevator looks like;

Figure 1:
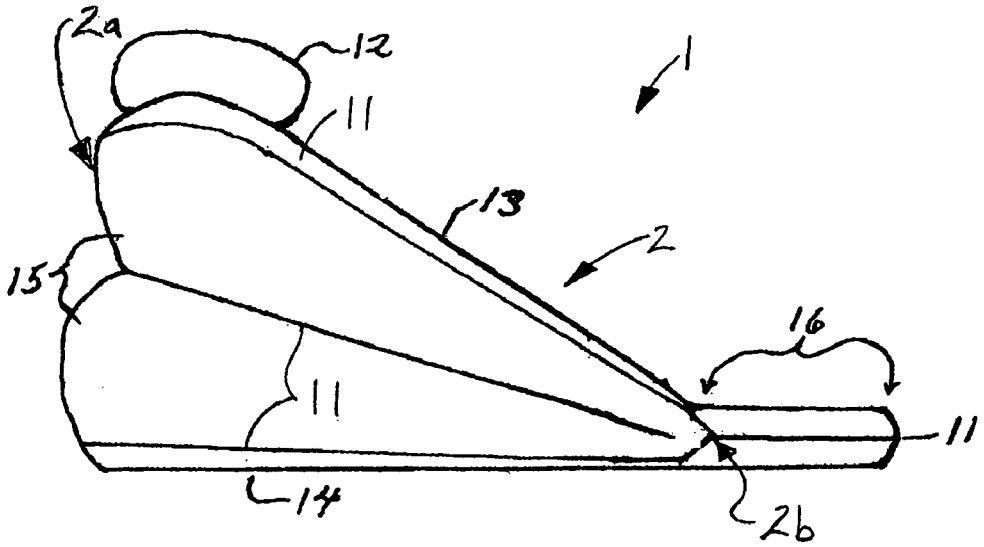
FIG. 1 illustrates aspects of the design of the "Upper Body Elevator" from a side view; showing the upper, lower, and gusset sections with the optional pillow, in accordance with an embodiment of the present device.

Unless otherwise indicated illustrations in the figures are not necessarily drawn to scale.

SUMMARY OF THE INVENTION

To achieve the foregoing and other objects and in accordance with the purpose of the device, an apparatus for an "Upper Body Elevator" is described.

In one embodiment, an Upper Body Elevator apparatus having an elevating wedge optional pillow, pneumatic cushions and anchor/butt rest is designed to provide recreational and therapeutic lounging operable to elevate the head at a comfortable angle. An anchor/butt rest is shown comprising double heat-sealed elongated tubes for buttock support. Top and bottom heat-sealed pillows are connected together by a diaphragm for added back support. The connected pillows are configured to provide support for the upper appendage of the body when lounging in a semi-upright position. An optional pillow is added for optional head support when needed.

This embodiment is designed as an inflatable, portable, multi-use, elevating wedge. This embodiment is also cost efficient.

Other features, advantages, and objects of the present device will become more apparent and be more readily understood from the following detailed description, which should be read in conjunction with the accompanying drawings.

DETAILED DESCRIPTION OF THE PREFERRED EMBODIMENTS

The present device is best understood by reference to the detailed figures and description set forth herein.

Embodiments of the device are discussed below with reference to the Figures. However, those skilled in the art will readily appreciate that the detailed description given herein with respect to these figures is for explanatory purposes as the device extends beyond these limited embodiments.

A portable upper body elevator will be described in which the preferred embodiment combines a pneumatic cushion and hospital wedge. It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details. It is to be further understood that while many design features are described below in the context of complying with pertinent government regulations, alternative embodiments and applications of the present may include corresponding design features that may be only partially or not at all in compliance, such non-compliant embodiments and applications of the present device are none-the-less within the scope of the present device. Likewise, all safety oriented design features are optional, and may be replaced with any suitable implementation approach known to those skilled in the art.

It is contemplated that other embodiments of the present invention may implement other suitable designs, depending upon the needs of the particular consumer, for example, without limitation, the base could be curved, however this embodiment places too much support on the upper body extremities and is preferred for those consumers in a vegetative or infantile state such as convalescence, disabled consumers or infants. This device is more suitable for anyone who likes lounging but prefers to do so in a semi-upright position. This device is to be used for recreational and/or therapeutic purposes for older children up to adult and is not suitable to be used as a flotation device.

The entire device is portable and a covering for the cushions is recommended to help prevent skin from sweating, sliding, and accidental punctures or tears to the cushions. The device may be placed on the floor inside, outside, on the ground—concrete, grass or dirt. The measurements provided are for the preferred embodiment of the present device, and those skilled in the art, in light of the present teachings, will recognize that alternate measurements may also be suitable for an Upper Body Elevator.

The present embodiment is comprised of two main portions using a type of plastic/rubberized plastic, vinyl, lightweight material suitable for inflation. This material can be made from a flame retardant, waterproof, non-breathable material that is mildew proof, or covered with nonflammable, waterproof material. The device is preferably flame retardant, and meets pertinent government regulations; such as, without limitation, the NFPA 701 Flame Resistance and MIL-F-21840F shear strength requirements. The vinyl portions are preferably waterproof, tear resistant, rot resistant, and are in compliance with pertinent government regulations; such as, without limitation. NFPA 701 Flame Resistance and State of Louisiana F-222.03 Flame Retardant Rating.

DETAILED DESCRIPTION OF THE PREFERRED EMBODIMENTS

Figure 2:
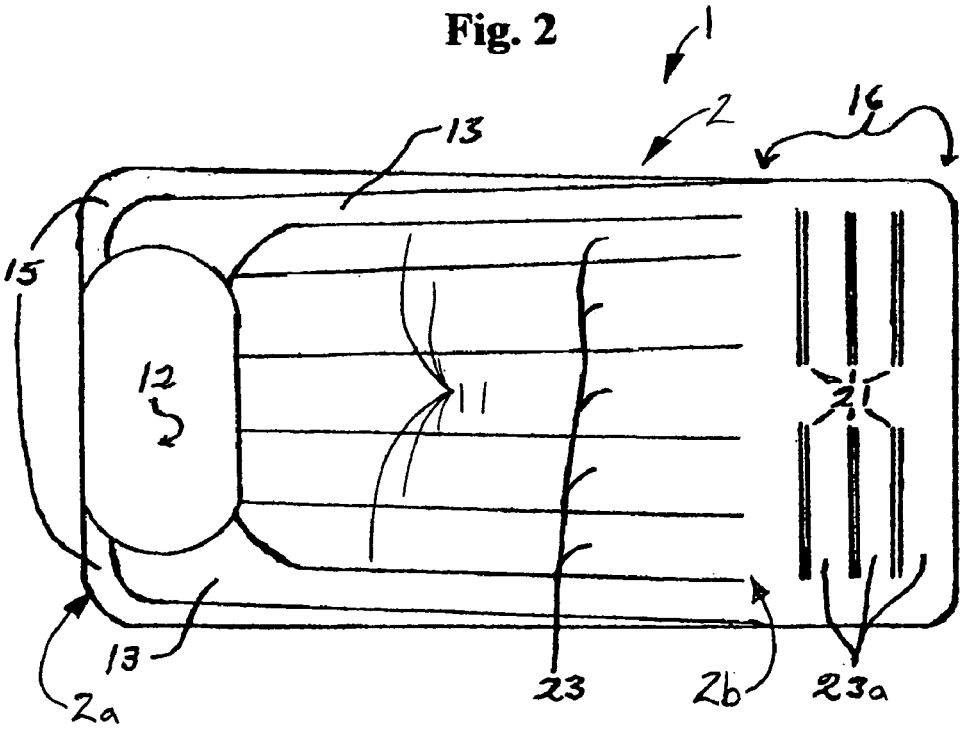

Referring to FIGS. 1-5 of the drawings, an illustrative embodiment of the upper body elevator 1 is illustrated. The upper body elevator 1 includes an elevator body 2 which may have a generally elongated, rectangular shape in top view, as illustrated in FIG. 2, with a first end 2*a* and a second end 2*b* spaced-apart from the first end 2*a*. The elevator body 2 may generally have a wedge shape when viewed in side view, as illustrated in FIG. 1. The elevator body 2 includes heat sealed pillows 11. In some embodiments, a head pillow 12 may be provided at the first end 2*a* of the elevator body 2. The elevator body 2 may have a generally sloped or wedge-shaped configuration when viewed in side view (FIG. 1). At the first end 2*a* and the sides of the elevator body 2, gussets 15 may attach the heat sealed pillows 11 to each other. An anchor/butt rest 16 may be provided at the second end 2*b* of the elevator body 2. In application of the upper body elevator 1, which will be hereinafter described, the upper body of a user (not illustrated) is elevated by using heat-sealed pillows 11 as the user reclines on the elevator body 2. In some embodiments, the elevator body 2 may be covered with a bottom sheet 14 and a top sheet 13, respectively.

Figure 3:
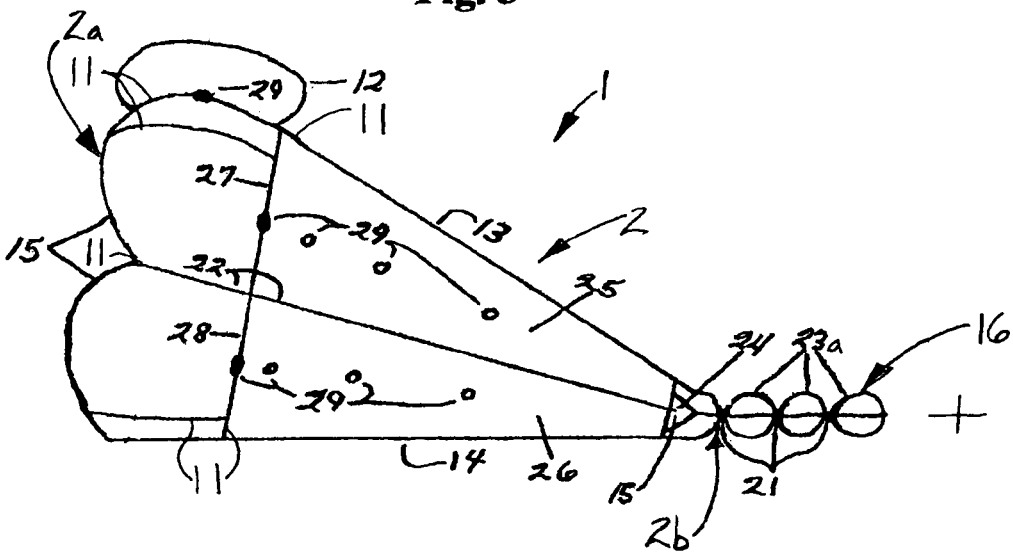
FIG. 3 illustrates a side view and cutaway sections showing the inner construction and parts, in accordance with an embodiment of the present device.
Figure 4:
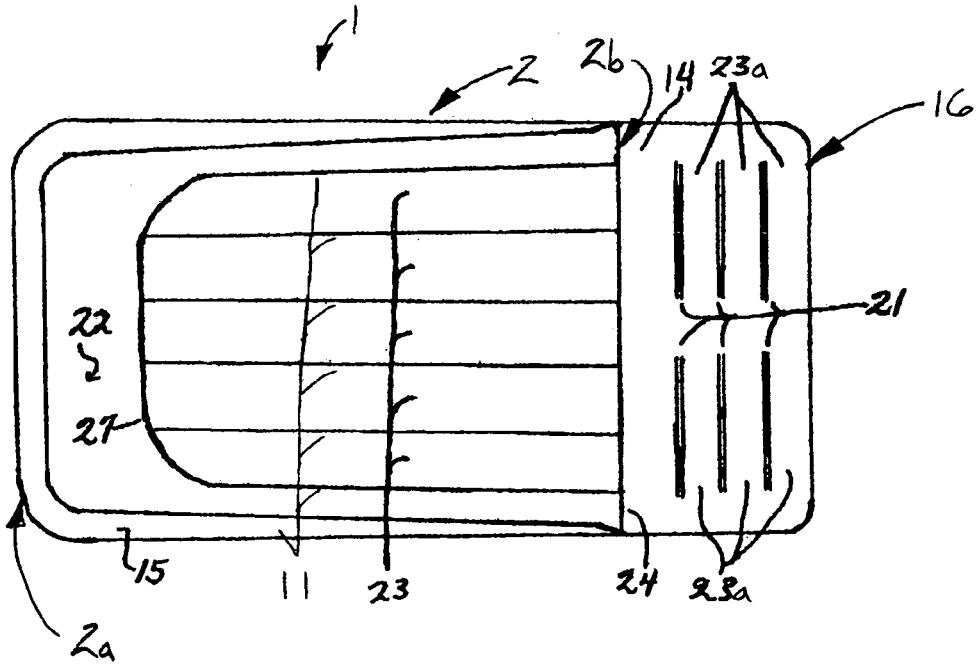
FIG. 4 is a detailed top view and cutaway sections showing the inner construction and parts, in accordance with an embodiment of the present device

FIG. 2 shows a view from above for a better understanding of what the upper body elevator 1 looks like. In some embodiments, the elevator body 2 may be inclined at an angle of about 20-40 degrees. Multiple parallel, spaced-apart, elongated air tubes 23 which in some embodiments may be double heat-sealed to each other may extend through the elevator body 2*a*. The air tubes 23 are designed to create a pillow type effect for support of any recreational or therapeutic activity as a user reclines on the elevator body 2. As illustrated in FIGS. 2-4, in some embodiments the air tubes 23 may be oriented in generally parallel relationship with respect to a longitudinal axis of the elevator body 2. The optional pillow 12 which may be provided on the elevator body 2 serves as neck rest to this embodiment. Along with anchor/butt rest 16 for support of the buttocks area of a user, the top sheet 13 may be provided on the elevator body 2 for support and comfort to skin, reduction in sliding and easy care.

Figure 5:
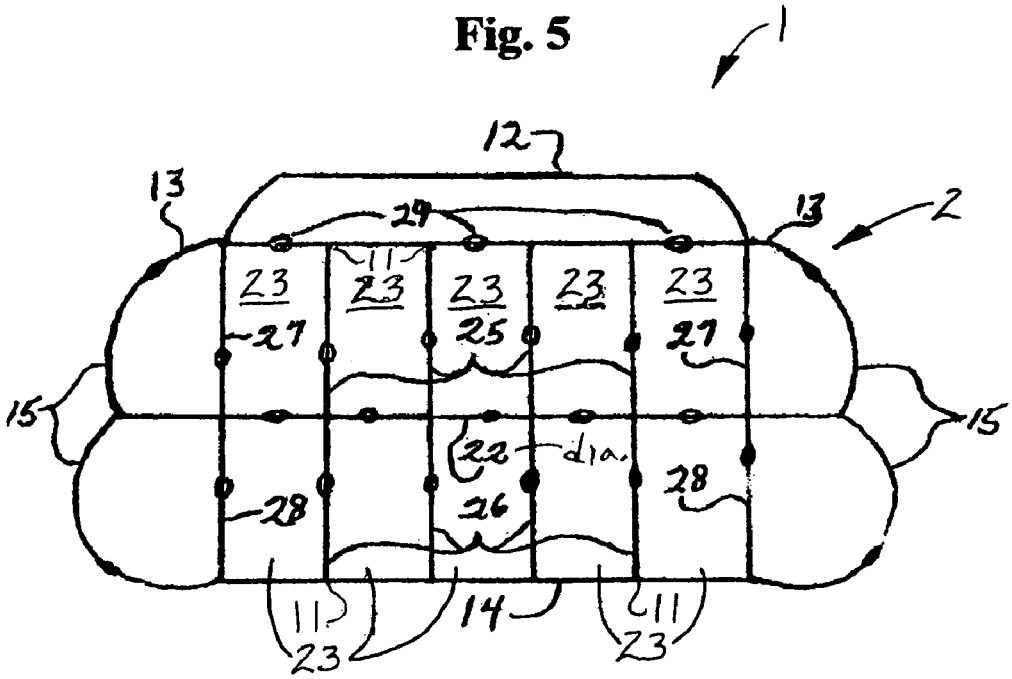
FIG. 5 illustrates a cross section view construction and parts, in accordance with an embodiment of the present device.

FIG. 3 shows a side view and cutaway section showing the inner construction and parts of the elevator body 2 and is a detailed view of the angle and height of the elevator body 2. As illustrated in FIGS. 3-5, U shaped upper baffles 27 may terminate one end of the air tubes 23 of the upper portion of the elevator body 2*a*. U shaped lower baffles 28 may terminate one end of the air tubes 23 of the lower portion of the elevator body 2*a*. A diaphragm 22 may separate the air tubes 23 of the lower portion of the elevator body 2 from the air tubes 23 of the upper portion of the elevator body 2. The diaphragm 22 may terminate in a diaphragm end 24 (FIG. 3) at the second end 2*b* of the elevator body 2. Upper tube partitions 25 may separate the adjacent air tubes 23 of the upper portion of the elevator body 2 from each other. Lower tube partitions 26 may separate the adjacent air tubes 23 of the lower portion of the elevator body 2 from each other.

FIG. 4 illustrates a top view and cutaway section showing the inner construction and parts in accordance with an illustrative embodiment of the upper body elevator 1. The gussets 15 connect the bottom sheet 14 to the diaphragm 22 and the diaphragm 22 to the top sheet 13. The anchor/butt rest 16 may include multiple, adjacent elongated air tubes 23*a* that are connected to the bottom sheet 14 at a diaphragm end 24 of the diaphragm 22. As illustrated in FIG. 3, in some embodiments the adjacent air tubes 23*a* of the anchor/butt rest 16 may be attached to each other at a double heat seal 21.

FIG. 5 shows a cross section view, construction and parts of the typically heat-sealed air tubes 23 of each of the lower portion of the elevator body 2 and the upper portion of the elevator body 2. Shown is the optional head rest pillow 12 attached to top sheet 13 which may be a waterproof, nonporous, mildew resistant material. The diaphragm 22 may separate the air tubes 23 of the lower portion of the elevator body 2 from the air tubes 23 of the upper portion of the elevator body 2. The upper and lower tube partitions 25 and 26, respectively, may form the sides of each air tube 23. The outer air tubes 23 of the upper portion of the elevator body 2 and the outer air tubes 23 of the lower portion of the elevator body 2 may be bound by upper and lower U shaped baffles 27 and 28, respectively. The U shaped upper baffles 27 and the U shaped lower baffles 28 are used to connect each elongated air tube 23 in the innermost area of the lower and upper portions of the elevator body 2, respectively. Connected to the elevator body 2 is a bottom sheet 14 which may be also made of waterproof, nonporous, mildew and slip resistant material. As illustrated in FIGS. 3 and 5, air diffusers 29 may be provided in each of the diaphragm 22, the upper tube partitions 25, the lower tube partitions 26, the upper baffles 27 and the lower baffles 28. At least one air diffuser 29 may also be provided between the head pillow 12 and the elevator body 2. The air diffusers 29 may facilitate flow of air between the air tubes 23 of the lower portion of the elevator body 2, between the air tubes 23 of the upper portion of the elevator body 2, and between the pillow space 3 and each of the lower and upper portions of the elevator body 2.

In typical application of the upper body elevator 1, a user (not illustrated) reclines on the elevator body 2 with the user's back resting on the upper elevator pillow 11*a* and the user's rear end resting on the anchor/butt rest 16. Accordingly, the upper body elevator 1 imparts comfort and rest to the user and may be suitable for therapeutic applications.

Figure 6:
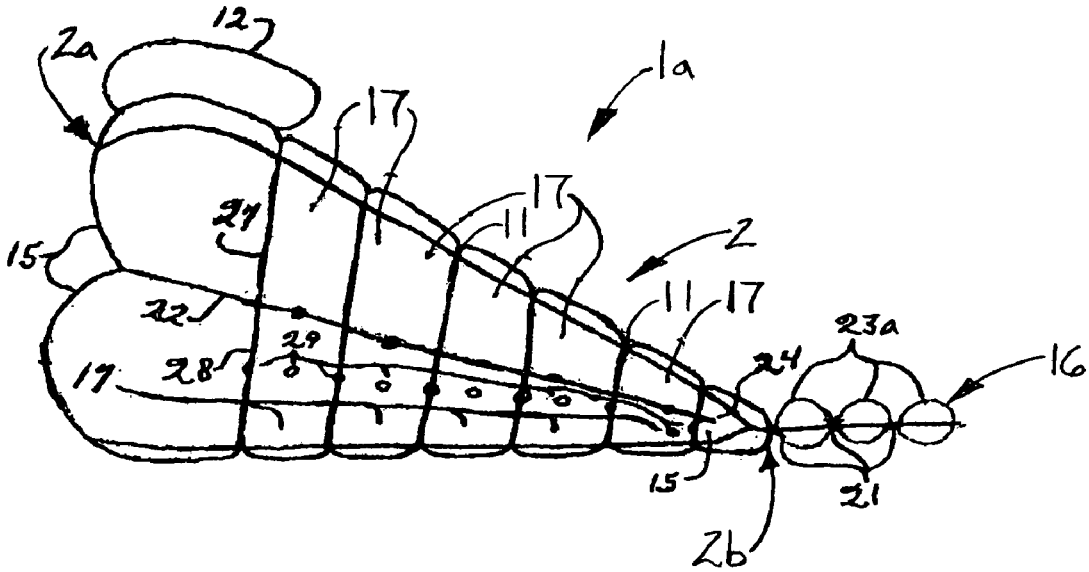
FIG. 6 shows an illustration of "FIG. 3" embodiment with a transverse or crossways tubular configuration, in accordance with an embodiment of the present device.
Figure 7:
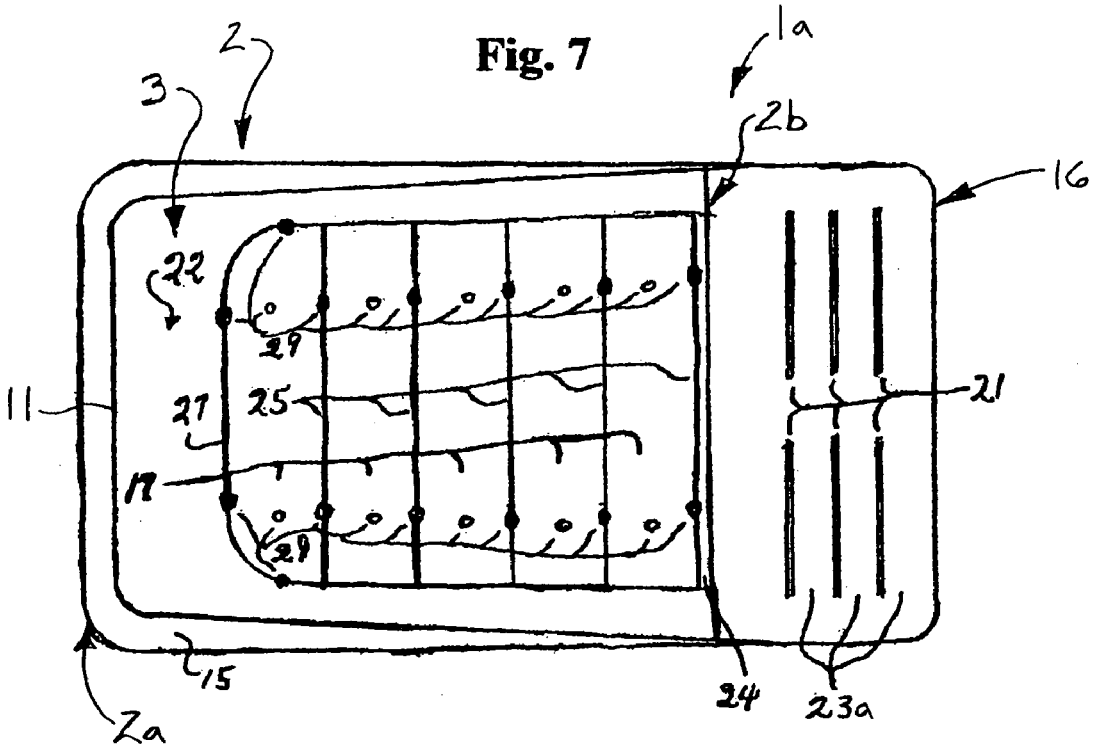
FIG. 7 shows an illustration of "FIG. 4" embodiment with a transverse or crossways tubular configuration, in accordance with an embodiment of the present device.

Referring next to FIGS. 6 and 7 of the drawings, an alternative illustrative embodiment of the upper body elevator 1*a* having a transverse or crossways tubular configuration is illustrated. The lower and upper portions of the elevator body 2 may be connected by gussets 15 with optional head pillow 12 connected to the upper portion of the elevator body 2. Lateral air tubes 17 are interconnected to form both the lower and upper portions of the elevator body 2, respectively. The lateral air tubes 17 may be oriented in generally transverse relationship with respect to the longitudinal axis of the elevator body 2. The diaphragm 22 may separate the lower portion of the elevator body 2 and the upper portion of the elevator body 2 from each other. Configuration also shows U shaped upper baffles 27 which connect the lateral air tubes 17 in the lower portion of the elevator body 2 and U shaped lower baffles 28 which connect the lateral air tubes 17 in the upper elevator pillow 11*a*. This figure also shows air diffusers 29 in the upper tube partitions 25 and the lower tube partitions 26 which separate the adjacent lateral air tubes 17 in the lower portion of the elevator body 2 and in the upper portion of the elevator body 2, respectively. The gussets 15 may connect the diaphragm end 24 of the diaphragm 22 to the anchor/butt rest 16, which may include lateral air tubes 17*a* adjacent ones of which may be connected to each other at a double heat seal 21.

FIG. 7 shows the upper body elevator 1*a* with transverse lateral air tubes 17 in top view. Adjacent lateral air tubes 17 of the upper portion of the elevator body 2 may be separated by upper tube partitions 25. Adjacent lateral air tubes 17 of the lower portion of the elevator body 2 may be separated by lower tube partitions 26 (FIG. 6). Air diffusers 29 may be provided between the lateral air tubes 17 of each of the lower portion of the elevator body 2 and the upper portion of the elevator body 2. Use of the upper body elevator 1*a* may be as was heretofore described with respect to the upper body elevator 1 in FIGS. 1-5.

The foregoing embodiments of the present device comprise a multiplicity of aspects, which, for the sake of clarity, are next highlighted separately by way of example and not limitation. For example, one aspect of the preferred embodiment of the present device is to provide adjustable elevation of the consumer's head with the use of an optional head rest that provides a certain degree of elevation (approximately 20-40 degree range) and allow for comfortable, effective, versatile positioning of the head and chest of the consumer.

Another aspect of the preferred embodiment, provides for a modified natural curvature of the body that comfortably supports the back and the buttocks, without restricting blood circulation to the lower body and helps to prevent the consumer from slipping down, slumping the head and neck to occlude the airway or cause poor air exchange to the lungs. The design of the preferred embodiment allows for the recommended supine, as well as prone and side lying positioning of the consumer.

Yet another aspect of the preferred embodiment of the present device is that the structure allows for easy breathing, reading, and any other type of relaxation techniques that require one to sit in a semi-upright position due to its constructed elevation. It is contemplated that the entire unit of the present embodiment being constructed of a pneumatic inflatable cushion, its portability can be accessed to fit the specific needs of the consumer. The invention could be made transparent, colored, or patterned because of its material.

Another aspect of the preferred embodiment of the present device is that it can be easily cleaned and meets most, if not all, sanitation needs for its repeated use. Another aspect of the preferred embodiment of the present device is that it is constructed of durable and waterproof materials.

Embodiments of the present device may be used in the home or outside the home for use by anyone who participates in recreational or therapeutic lounging.

Alternative embodiments can not address cost reduction or regulatory issues for certain applications like this one.

Having fully described at least one embodiment of the present device, other equivalent or alternative methods of implementing an upper body elevator according to the present device will be apparent to those skilled in the art. The device has been described above by way of example, and the specific embodiments disclosed are not intended to limit the device to the particular forms disclosed. This device is thus to cover all modifications, equivalents, and alternatives falling within the spirit and scope of the following claims.

LEGEND

Drawings

Figures

In the drawings, closely related figures have the same numbers but different alphabetic suffixes.

FIG. 1 shows various aspects of the same design of the "Upper Body Elevator" from elevation/side view showing the upper, lower and gusset sections with the optional pillow.

FIG. 2 shows a view from above for a better understanding of what the Upper Body Elevator looks like.

FIG. 3 shows side views cutaway sections, showing the inner construction and parts.

FIG. 4 shows top views cutaway sections showing the inner construction and parts.

FIG. 5 shows a cross section view, construction and parts.

FIG. 6 shows an illustration of "FIG. 3" embodiment with a transverse or crossways tubular configuration.

FIG. 7 shows an illustration of "FIG. 4" embodiment with a transverse or crossways tubular configuration.

DRAWINGS

Reference Numerals

11 pillows heat-seal
12 pillow (optional)

13 top sheet
14 bottom sheet
15 gussets
16 anchor/butt rest
17 lateral tube/crossways
21 double heat-sealed
22 diaphragm
23 elongated tubes
24 diaphragm end
25 upper baffles
26 lower baffles
27 U shaped upper baffles
28 U shaped lower baffles
29 air diffusers

The invention claimed is:

1. An upper body elevator, comprising:

an elevator body rectangular in top view and wedge-shaped in side view and comprising:

a first plurality of adjacent air tubes extending in side-by-side relationship generally across a width of the elevator body;

second plurality of adjacent air tubes carried by the first plurality of adjacent air tubes and extending in side-by-side relationship generally across the width of the elevator body;

a first plurality of air diffusers establishing air communication between the first plurality of adjacent air tubes;

a second plurality of air diffusers establishing air communication between the second plurality of adjacent air tubes; and a third plurality of air diffusers establishing air communication between the first plurality of adjacent air tubes and the second plurality of adjacent air tubes.

2. The upper body elevator of claim 1 further comprising at least one baffle provided in the elevator body generally adjacent to the first plurality of adjacent air tubes and the second plurality of adjacent air tubes.

3. The upper body elevator of claim 2 wherein the at least one baffle comprises a lower baffle adjacent to the first plurality of adjacent air tubes and an upper baffle adjacent to the second plurality of adjacent air tubes.

4. The upper body elevator of claim 1 further comprising an anchor/butt rest carried by the elevator body.

5. An upper body elevator, comprising:

an elevator body rectangular in top view and wedge-shaped in side view and having a first end and a second end spaced-apart from the first end and comprising:

a pair of gussets provided in the elevator body generally at the first end of the elevator body:

a first plurality of adjacent air tubes provided generally between the pair of gussets and the second end of the elevator body and extending in side-by-side relationship generally across a width of the elevator body;

a plurality of lower tube partitions separating the first plurality of air tubes from each other:

a first plurality of air diffusers in the plurality of lower tube partitions, respectively, and establishing air communication between the first plurality of adjacent air tubes;

a second plurality of adjacent air tubes provided generally between the pair of gussets and the second end of the elevator body and extending in side-by-side relationship generally across a width of the elevator body;

a plurality of upper tube partitions separating the second plurality of air tubes from each other;

a second plurality of air diffusers in the plurality of upper tube partitions, respectively, and establishing air communication between the second plurality of adjacent air tubes;

a diaphragm separating the first plurality of air tubes from the second plurality of air tubes;

a third plurality of air diffusers in the diaphragm and establishing air communication between the first plurality of adjacent air tubes and the second plurality of adjacent air tubes;

a lower baffle terminating the first plurality of adjacent air tubes;

an upper baffle terminating the second plurality of adjacent air tubes;

a head pillow carried by the elevator body; and at least one air diffuser establishing air communication between the head pillow and the second plurality of adjacent air tubes.

6. The upper body elevator of claim 5 further comprising an anchor/butt rest carried by the second end of the elevator body.

7. The upper body elevator of claim 5 further comprising a bottom sheet provided on the first plurality of adjacent air tubes and a top sheet provided on the second plurality of adjacent air tubes.

* * * * *